United States Patent [19]

Edwards

[11] 4,196,680

[45] Apr. 8, 1980

[54] CONTROL DEVICE FOR USE IN SEWING BUTTONHOLES

[75] Inventor: William J. Edwards, Cranbury, N.J.

[73] Assignee: The Singer Company, New York, N.Y.

[21] Appl. No.: 19,063

[22] Filed: Mar. 9, 1979

[51] Int. Cl.[2] ..... D05B 3/24; D05B 3/06

[52] U.S. Cl. ..... 112/77

[58] Field of Search ..... 112/77, 70, 73, 75, 112/76, 158 B, 158 R, 235, 65, 66, 67

[56] References Cited

U.S. PATENT DOCUMENTS

| | | | |
|---|---|---|---|
| 3,113,537 | 12/1963 | Bono | 112/158 B |
| 3,117,542 | 1/1964 | Schenkengel | 112/77 |
| 3,131,658 | 5/1964 | Yanagibayashi et al. | 112/158 B |
| 3,656,443 | 4/1972 | Ross | 112/158 B X |
| 3,841,246 | 10/1974 | Casner et al. | 112/158 B X |
| 3,877,403 | 4/1975 | Ketterer | 112/77 |
| 4,056,070 | 11/1977 | Haut | 112/158 B |
| 4,091,752 | 5/1978 | Odermann | 112/77 X |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A buttonhole controlling device for use in causing a sewing machine to form a buttonhole of a selected length, and including means for effecting a reversal in the direction in which material is fed under a sewing needle as required for the formation of a final leg of the buttonhole, is provided with an adjustable stop enabling an operator to precisely define the end position of the final leg and so assure closure of the buttonhole without overlap.

5 Claims, 5 Drawing Figures

CONTROL DEVICE FOR USE IN SEWING BUTTONHOLES

BACKGROUND OF THE INVENTION

1. Field of the Invention

The invention relates to buttonhole controlling devices for a sewing machine.

2. Description of the Prior Art

Buttonhole controlling devices which a sewing machine operator may use to select the length of a buttonhole to be sewn and which are effective to cause a machine when in a buttonhole mode to automatically sew a buttonhole of the selected length are well known. While such a device may prove effective to cause neat buttonholes to be formed in one type of material, it may not produce the desired result in other fabrics. This is due to the fact that different materials vary in the extent to which they slip relative to the feed dog of a machine during sewing. As a consequence, buttonholes may be formed in which the stitching fails to close or in which the stitching extends beyond the desired point of closure.

It is a prime object of the present invention to provide a buttonhole controlling device which can be rendered effective regardless of the type of material being sewn to cause buttonhole stitching to close without overlap.

SUMMARY OF THE INVENTION

The buttonhole controlling device of the invention includes a foot pad which attaches to a presser bar, and a travelling assembly having an initial position relative to the foot pad as defined by oppositely acting springs. The travelling assembly moves with work fed during the sewing of a buttonhole and includes a slidable member that may be positioned by a button for which a buttonhole is to be sewn. The slidable member positionable by a button carries a tab to actuate a tripping lever on the machine during movement of the assembly and cause the length of a buttonhole formed with the buttonhole device be limited to that suitable for the button inserted in the travelling assembly. An adjustable stop mounted on the travelling assembly engages the tripping lever to terminate the formation of a buttonhole. By properly positioning the stop, an operator can precisely define the closure point and so prevent the formation of an open buttonhole or one in which stitches overlap.

DESCRIPTION OF THE PREFERRED EMBODIMENT

Figure 1:
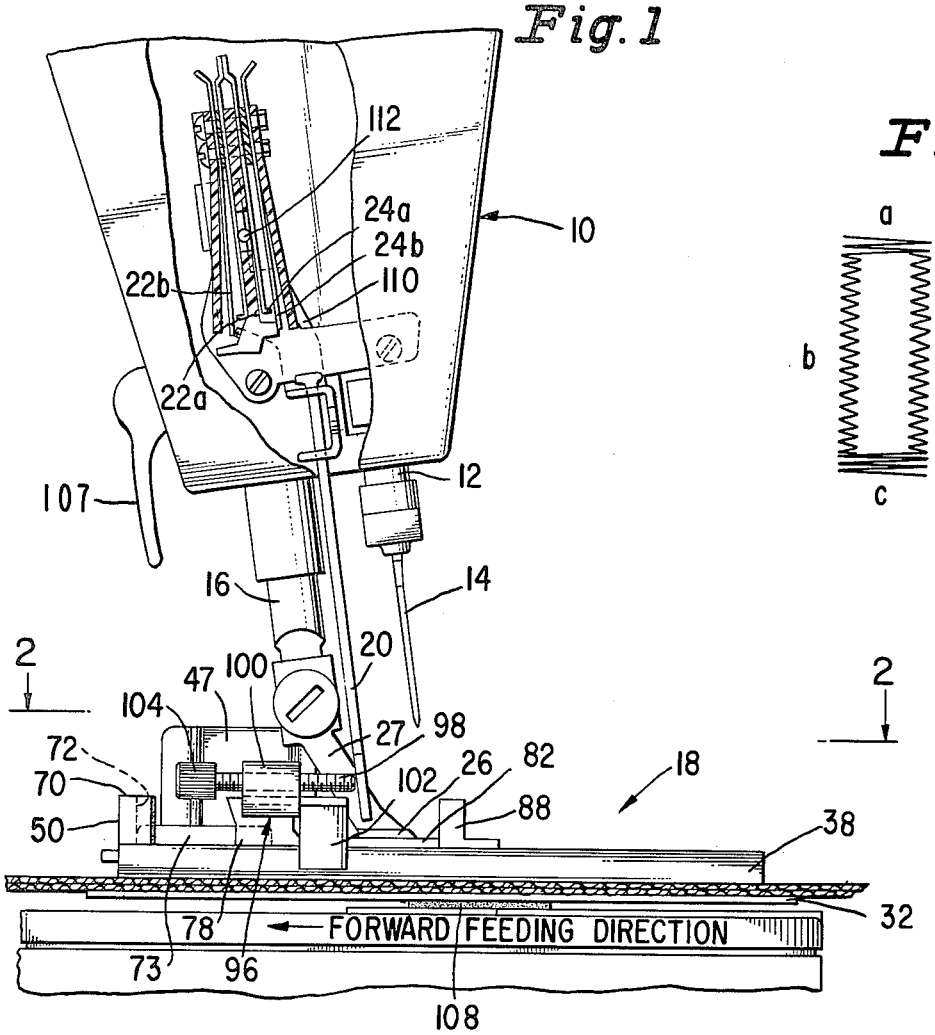
FIG. 1 is a fragmentary head end elevational view of a sewing machine including the buttonhole controlling device of the invention.

Referring to the drawings, reference character 10 designates the head end of a sewing machine wherein a needle bar 12 is vertically reciprocable. A sewing needle 14 is affixed to the needle bar 12 for reciprocation thereby. The machine carries a presser bar 16 to which the buttonhole controlling device 18 of the invention attaches, and also a tripping lever 20. Buttonhole controlling device 18 is peculiarly adapted to accomplish the primary objective of the invention but is generally similar to the device disclosed in U.S. Pat. No. 3,877,403 of The Singer Co. and reference to such patent may be made for any details of construction not specifically described herein.

Figure 5:
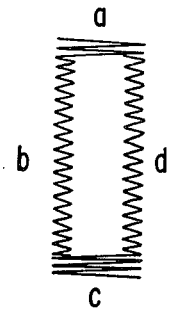
FIG. 5 indicates buttonhole stitches formed with the aid of the buttonhole device of the invention.
Figure 2:
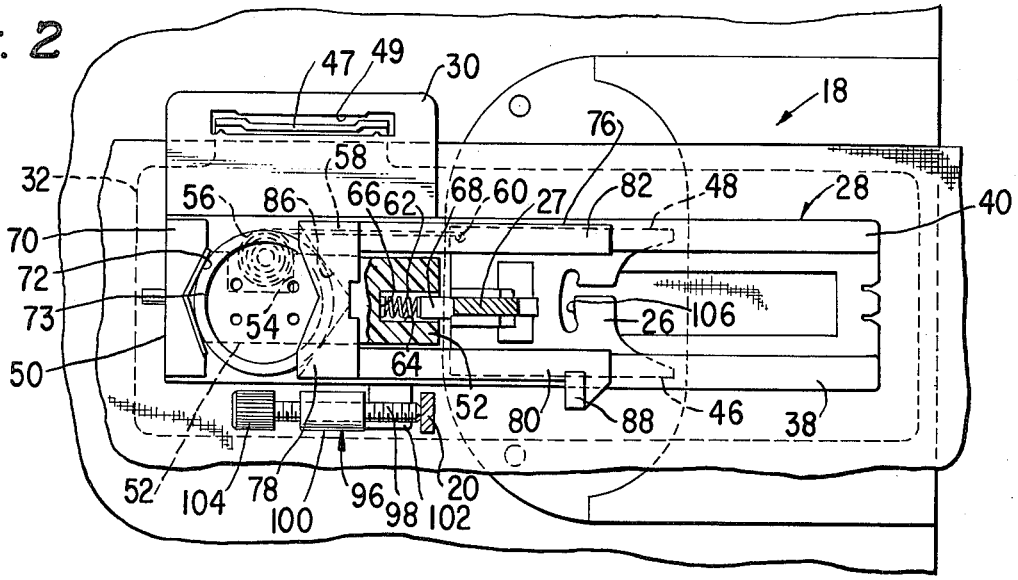
FIG. 2 is a fragmentary plan view taken substantially on the plane of the line 2—2 of FIG. 1, and showing the travelling assembly on the device of the invention in an initial position.
Figure 3:
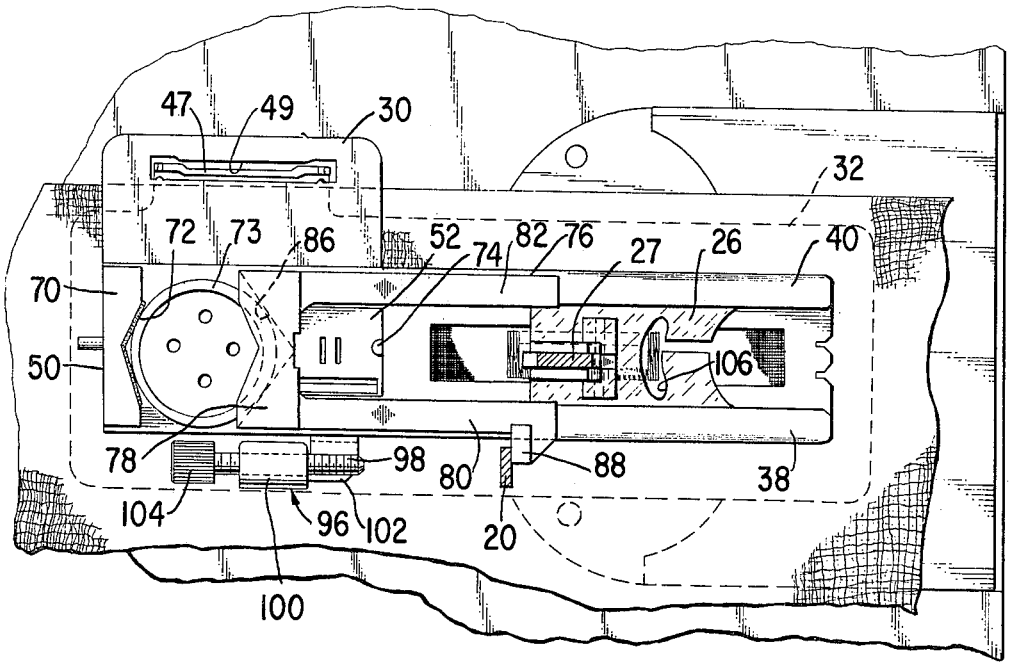
FIG. 3 is a view similar to FIG. 2 showing the travelling assembly upon completion of a bar at the end of the first leg of a buttonhole.
Figure 4:
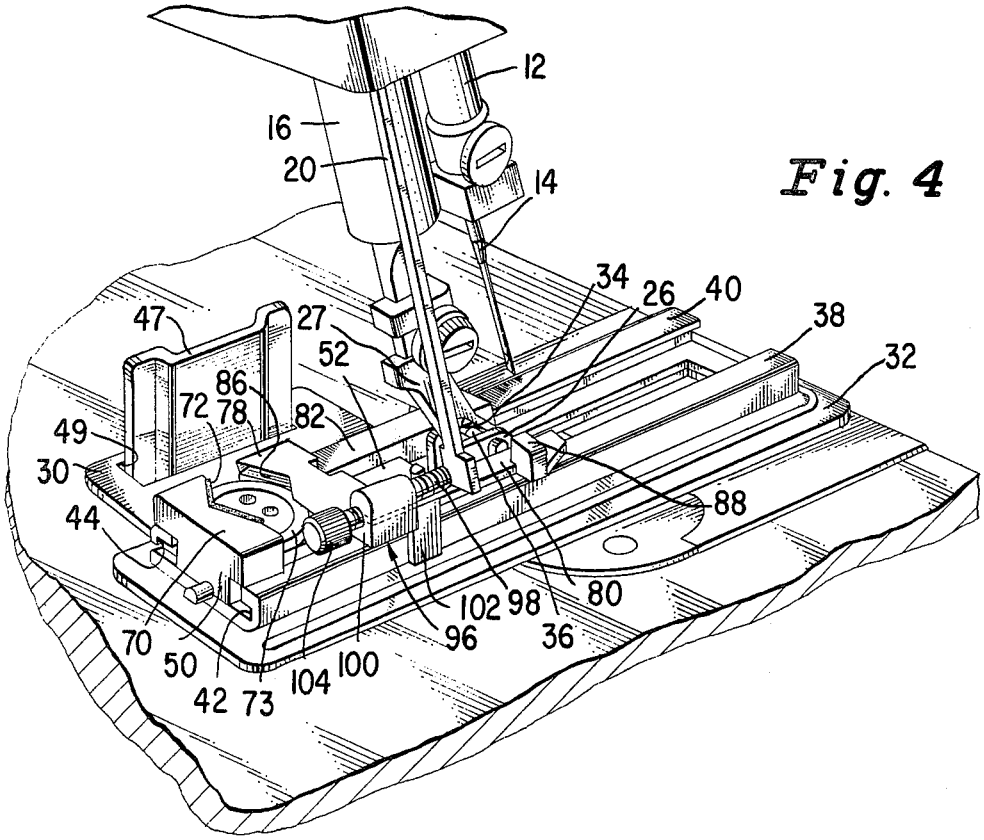
FIG. 4 is a fragmentary perspective view showing the travelling assembly at the completion of the buttonhole.

The device 18 controls the operation of the tripping lever 20 and the tripping lever controls flexible contacts *22a, 22b* and *24a, 24b* to cause the machine to sew a buttonhole when in a buttonhole mode. The particular manner in which the machine is constructed to cause a buttonhole to be sewn in response to the operation of the contacts *22a, 22b* and *24a, 24b* constitutes no part of the invention and is therefor not described herein. It is sufficient here to note that the machine operates as in U.S. Pat. No. 3,841,246 to cause top bar stitches a and left leg zig-zag stitches b constituting a first half of a buttonhole to be formed with the tripping lever in a forward position (away from the operator), and cause bottom bar stitches c and right leg zig-zag stitches d constituting a second half of the buttonhole to be formed with the tripping lever in a rearward position (toward the operator) (see FIG. 5). The machine may, for example, be constructed in the manner of the "TOUCH-TRONIC" 2001 electronic sewing machine manufactured and sold by The Singer Company.

Buttonhole controlling device 18 includes a foot pad 26, and also a travelling assembly 28 consisting of a work engaging shoe 30 and plate 32. Foot pad 26 attaches to a presser bar attachment 27 in a slot 34 provided at the end thereof to receive a pin 36 affixed in the foot pad. The shoe 30 includes rails 38 and 40 which form guide channels 42 and 44 for side edges 46 and 48 respectively of the pad 26 to permit relative sliding of the travelling assembly and foot pad. The work engaging shoe 30 and plate 32 are separable parts held in assembled relationship with a wall 47 on the plate extending upwardly through a slot 49 in the shoe.

The shoe 30 includes as a fixed part thereof, an anchor element 50 which is formed with a base 52. The base defines a shallow cavity 54 loosely accommodating a coiled end 56 of a flat spring 58 of which the other end is secured at 60 in foot pad 26. The base 52 is also provided in accordance with the invention with a horizontally extending helical spring 62 in a recess 64 where one end rests against an abutment 66. The other end of the spring 62 is engageable by a tab 68 on the foot pad 26. The two springs 58 and 62 define an initial position for the travelling assembly 28 relative to the foot pad 26. As shown, the anchor element 58 includes an upstanding abutment 70 which is formed with a "V" notch 72 adapted to engage and center one side of a round button 73, and includes a post 74 at the end of the base 52 remote from the "V" notch 72.

The shoe 30 is provided with a gaging element 76 which is formed with an upstanding abutment 78 and a set of rails 80 and 82 shaped to overlie and slide on the rails 38 and 40 respectively. Gaging element 76 may be shifted away from anchor element 50 to the extent permitted by abutment 78 engaging post 74. Abutment 78 is formed with a "V" notch 86 complemental to the "V" notch 72 in anchor element 50 for use in conjunction with the notch 72 for centering and locating a button therebetween.

A tab 88 for use in actuating tripping lever 20 is provided on rail 80 of gaging element 76. An adjustable stop 96 is also provided in accordance with the invention for use in actuating tripping lever 20 on rail 38 of the shoe 30. The position of actuating tab 88 with respect to adjustable stop 96 may be varied in accordance with the size of the button inserted between the "V" notches 72 and 86. As shown, the adjustable stop 96 includes a screw 98 having a threaded connection with a boss 100 which is affixed with a bracket 102 to rail 38. A knob 104 is provided on the screw 98 to facilitate turning by an operator. Tripping lever 20 extends in an operating position between tab 88 and screw 98 of the adjustable stop 96.

When buttonholes are to be sewn with the device 18, the button for use with such buttonholes is first placed between "V" notches 72 and 86 to position tab 88, and thereby establish the length of the buttonholes to be produced. A sample piece of the material to be sewn is located between the shoe 30 and plate 32. A buttonhole start line on the material is suitably located in an aperture 106 formed in the foot pad 26 and the presser bar is depressed with handle 106. The initial position of the travelling assembly 28 including the shoe 30 and plate 32 is defined by springs 58 and 62. Screw 98 is roughly adjusted by the operator to locate it in an intermediate position, such as to have it act against tripping lever 20, and cause the lever acting through a pivoted link 110 and pin 112 thereon to effect engagement of contacts *22a, 22b*. With contacts *22a, 22b* engaged, the machine is caused as soon as it is placed in a buttonhole mode to sew the top bar stitches a of FIG. 5 through aperture 106 in the foot pad 26. Following formation of the top bar stitches a, the machine sews left leg zig-zag stitches b as the travelling assembly 28 and the material being sewn is fed in a forward direction by feed dog 108. Contacts *22a, 22b* open as the travelling assembly moves forward, but the machine continues to operate without change until tab 88 comes into engagement with the tripping lever 20 and disposes it to cause flexible contact *24a* to engage flexible contact *24b* whereupon the machine is first caused to sew bottom bar stitches c. Following formation of the bottom bar stitches, the machine sews right leg zig-zag stitches d as the travelling assembly moves, in the reverse feed direction (toward the operator). Contacts *24a, 24b* are opened and the machine continues to operate without change until screw 98 engages lever 20 whereupon the sewing operation ceases.

After the completion of a buttonhole in the sample material, if the operator observes that the buttonhole stitches aren't closed by the right leg or that the right leg stitches extend beyond the top bar stitches, the operator can remedy the deficiency by adjusting screw 98 until the machine sews a perfect buttonhole. When the buttonhole is open, screw 98 is adjusted with knob 104 to retract the screw relative to lever 20, and when there is an overlap the screw is advanced with respect to lever 20. When a perfect buttonhole is obtained in the sample material, the operator can proceed to sew buttonholes in the garment of the same material. Whenever buttonholes are to be sewn in another garment of a different type of material the screw 98 is readjusted while working with a sample of the new material before buttonholes are sewn in the new garment to thereby compensate for possible slippage in different amounts of the different materials with respect to the travelling assembly 28.

It is to be understood that the present disclosure relates to a preferred embodiment of the invention which is for purposes of illustration only, and that various modifications may be made therein without departing from the spirit and scope of the invention as defined in the appended claims.

I claim:

1. A buttonhole controlling device for use on a sewing machine which includes a presser bar to which the device may be attached and a tripping lever for controlling the formation of buttonhole stitches, said device comprising a foot pad which attaches to the presser bar, a shoe which slides relative to the foot pad as work is fed on the machine during the formation of a buttonhole, oppositely acting springs biasing said shoe to an initial position with respect to the foot pad, a first stop on the shoe to initially position the lever so as to cause the formation of a first half of the buttonhole and to operate the lever as the buttonhole is completed to terminate the formation of stitches, and a second stop to operate the lever and initiate formation of the second half of the buttonhole after formation of the first half, said first stop being adjustable to enable an operator to define the location where stitches are terminated and thereby assure closure of the buttonhole and the avoidance of overlapping stitches.

2. A buttonhole controlling device as defined in claim 1 including means for positioning said second stop relative to the adjustable stop to thereby perdetermine the length of the buttonhole.

3. A buttonhole controlling device as defined in claim 2 wherein said positioning means includes a slide to which the second stop is attached and which is positionable by a button receivable on the shoe.

4. A buttonhole controlling device as defined in claim 1 wherein the adjustable stop is a screw adapted for turning at one end and engageable at the opposite end with the tripping lever.

5. The combination of claim 1 including flexible contacts operable by the tripping lever for controlling the operation of the sewing machine.

* * * * *